US005222657A

United States Patent [19]

Holland, Jr.

[11] Patent Number: 5,222,657

[45] Date of Patent: Jun. 29, 1993

[54] GAME PACKAGE

[75] Inventor: Warren L. Holland, Jr., Norfolk, Va.

[73] Assignee: Decipher, Inc., Norfolk, Va.

[21] Appl. No.: 831,264

[22] Filed: Feb. 6, 1992

[51] Int. Cl.[5] ..... B65D 5/42; B65D 75/54

[52] U.S. Cl. ..... 229/103; 206/459.5; 229/8; 446/79

[58] Field of Search ..... 229/8, 103, 161, 167; 206/459; 446/71, 79

[56] References Cited

U.S. PATENT DOCUMENTS

| | | | |
|---|---|---|---|
| 4,034,0908 | 7/1977 | Forbes, Jr. et al. | 229/167 |
| 1,662,899 | 3/1928 | Ridgway et al. | 229/8 |
| 1,682,594 | 8/1928 | Benjamin | 229/8 |
| 2,134,971 | 11/1938 | Guyer | 229/8 |
| 2,711,541 | 6/1955 | Bellett | 229/8 |
| 2,799,391 | 7/1957 | Eisner | 229/8 |
| 3,100,642 | 8/1963 | Goldstein | 206/459 |
| 3,155,392 | 11/1964 | Ruderian | 446/79 |
| 3,375,008 | 3/1968 | Atkinson | 229/103 |
| 3,659,773 | 5/1972 | Manizza | 229/161 |
| 4,301,614 | 11/1981 | Newton | 446/79 |
| 4,648,548 | 3/1987 | Shin | 229/8 |
| 5,110,038 | 5/1992 | Pantisano et al. | 229/103 |

FOREIGN PATENT DOCUMENTS

| | | | |
|---|---|---|---|
| 1047592 | 7/1953 | France | 229/8 |
| 602230 | 2/1960 | Italy | 229/167 |
| 692184 | 7/1965 | Italy | 229/167 |
| 406051 | 7/1966 | Switzerland | 229/8 |

*Primary Examiner*—Gary E. Elkins

*Attorney, Agent, or Firm*—Wegner, Cantor, Mueller & Player

[57] ABSTRACT

A game package shell is provided with a panel which includes pieces for the game. The package shell is unitary, thus decreasing collating expenses and reducing errors in associating pieces with games. In one embodiment, the game piece panel can be removable and be folded onto a panel which is provided with game rules. Removal of the game piece panel thereby exposes the game rules.

15 Claims, 2 Drawing Sheets

GAME PACKAGE

BACKGROUND OF THE INVENTION

The present invention provides a unitary package shell for a game. One panel of the shell includes components for the game, with the components being removable from this game component panel. This reduces the cost of collating pieces for games, and also reduces the possibility of incorrect pieces being associated with the game. The game package can be provided with a well for storing game components after they have been removed from the panel.

SUMMARY OF THE INVENTION

The present invention is directed to a unitary game package shell. The shell includes a plurality of shell panels linked together for forming the top, bottom and sides of the game package. A game component panel is linked to one of the shell panels and includes removable components for the game.

DETAILED DESCRIPTION OF THE INVENTION

Figure 1:
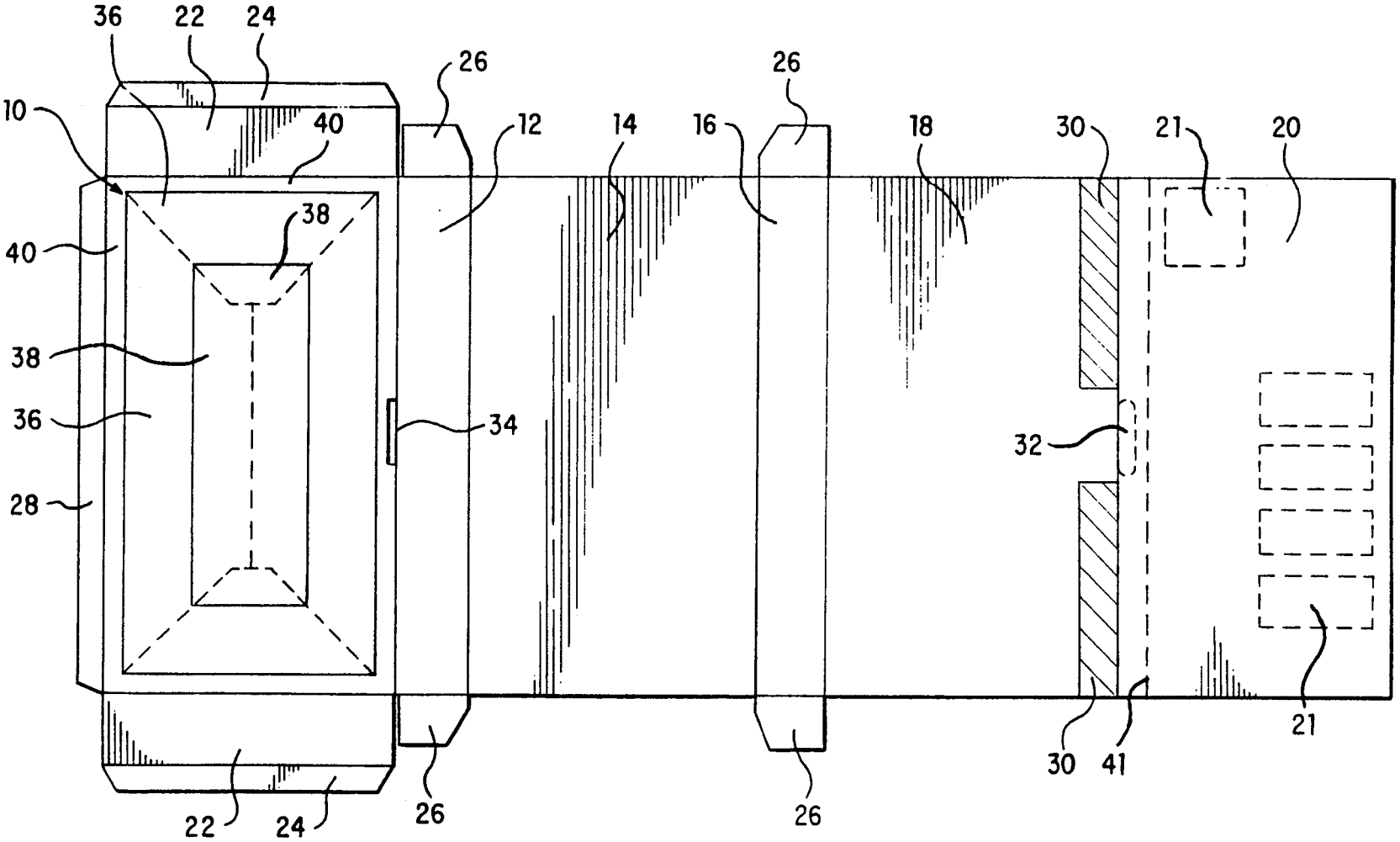
FIG. 1 shows a blank for forming a unitary game package shell according to the present invention, prior to folding.

Referring to FIG. 1 of the drawings, the game package shell of the present invention is formed by a number of panels. This general type of package is known as a simplex package. In the drawings, solid lines will represent fold lines, while the broken lines represent perforation lines or cuts.

The first panel 10 is provided with several cut-out sections to enable formation of a well, in a manner to be described below.

A second panel 12 is foldably joined to the first panel and extends from the first panel in a first direction. The second panel 12 forms one of the sides of the package.

Extending from the second panel 12 in the same direction is a third panel 14. This panel forms the bottom of the box. The fourth panel 16, which forms a second side of the package, is foldably joined to the third panel 14. Again, it can be seen that this panel extends from the third panel in the same direction that the third panel extends from the second panel.

A fifth panel 18 extends from fourth panel 16 in the same direction. Again, the panels are foldably joined. Panel 18 forms the top of the package.

Sixth panel 20 is foldably joined to fifth panel 18. This panel is provided with game components 21 for the game. The components are removable from the panel, for example by perforation. The game component panel 20 can be folded onto panel 18, as discussed in more detail below.

Two additional side panels 22 extend from the first panel in a direction perpendicular to the direction second panel 12 extends from the first panel. The panels 22 are foldable with respect to panel 10, and are provided with foldable tuck flaps 24. Side panels 12 and 16 are provided with notched support flaps 26.

Extending from panel 10 opposite to panel 12 is a glue panel 28. The glue is provided on the surface opposite to that shown in FIG. 1. Glue panel 28 is secured to side panel 16 in the manner described below.

Figure 2:
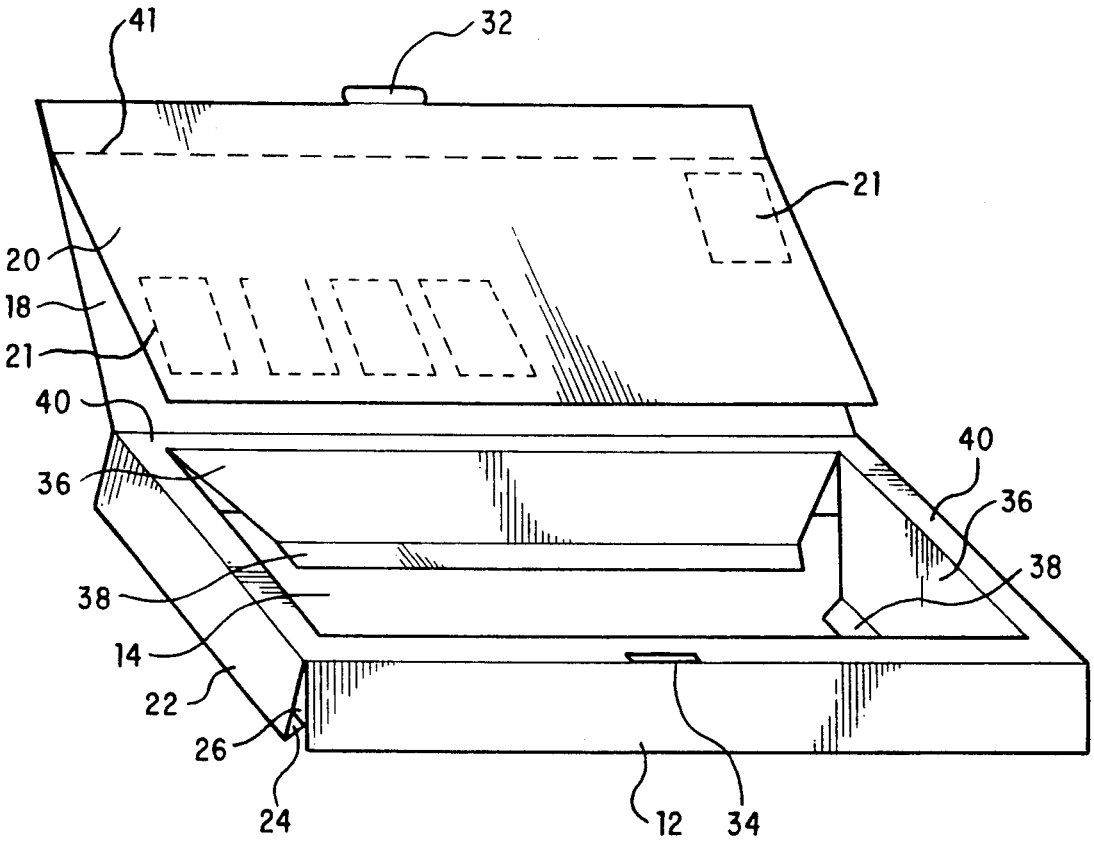
FIG. 2 shows a partially-assembled view of the game package shell.

A glue strip 30 is provided at the boundary between fifth panel 18 and sixth game component panel 20. The strip is illustrated as being applied to the fifth panel, but could also be applied to the sixth panel. While FIG. 2 shows panel 20 pivoted away from panel 18 for purposes of illustration, it has been found that the glue strip adjacent the fold line actually is sufficient for maintaining the sixth panel 20 in close contact with panel 18 after it is folded onto panel 18, and that it is not necessary to provide glue at the free end of panel 20. Panel 20 is also provided with a cut-out tab 32 which provides a tab protruding from panel 18. This tab cooperates with slot 34 formed in the first panel 10.

Referring to FIGS. 1 and 2, the construction of the package shell from the blank will now be described. The surface of panel 14 shown in FIG. 1 is the interior surface and again, panel 14 forms the bottom of the box. Therefore, panels 12 and 16 are folded upwardly from the plane of the drawing with respect to panel 14. Panel 10 is folded to the right in FIG. 1. Glue panel 28 is folded so that the glue-bearing surface can be brought into engagement with panel 16. Support flaps 26 are folded inwardly, and panels 22 are folded downwardly, with tuck flaps 22 sliding between support flaps 26 and bottom panel 14. Panel 20 is folded onto panel 18 (to the left in FIG. 1), and this combination is then folded to the left over panel 10, with tab 32 being foldable to engage tab slot 34.

The formation of the well from panel 10 will now be described. It can be seen that panel 10 is divided into four cut-out portions. Each of these cut-out portions is divided into separate sections 36, 38 and 40 by two fold lines. To form the well, sections 36 are folded downwardly to form side walls for the well, while sections 38 are folded inwardly with respect to the side walls to contact bottom panel 14. Sections 40 remain at the upper level and thus will be adjacent the top panel.

Figure 3:
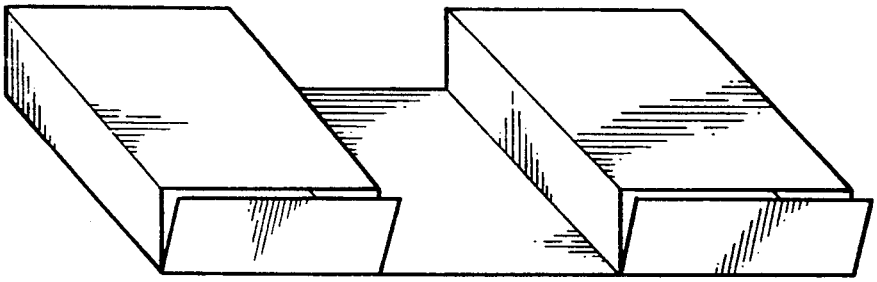
FIG. 3 shows a tray which can be used with the game package shell.

The game package can include a separate tray which is inserted into the well. This can improve the strength of the package, and because it can be made from a variety of materials in a variety of shapes, allows flexibility in the design of the game to meet the requirements of different markets. The tray can be used for storing game components after they have been removed from the panel 20, and can also be used for storing additional components for the game which are not included on the panel 20. FIG. 3 shows an example of a suitable tray, which can be made from a single folded sheet of a material such as paperboard or some other suitable material. The tray can be made by any other suitable technique, such as molding of plastic.

The package shell also can be made of paperboard or some other suitable material. The blank can be printed and cut to the desired size and shape from sheets. It is advantageous in cases where printing and final assembly are done at different locations for the shell to be partially assembled prior to shipping. Thus, the shell can be folded into a flat configuration in which the glue flap 28 is brought into contact with panel 16, i.e., by folding the glue panel 28 over and then folding panel 14 with respect to panel 12 so that panel 14 lies flush against panel 12, thereby bringing panel 16 into contact with glue panel 28. Panel 20 can be folded onto panel 18 at this stage as well. This provides the shell with a compact form that is easily shipped, but which is easily completed, i.e., "popped" open, at the final assembly stage.

In a preferred embodiment, rules for the game are provided on the surface of panel 18 shown in FIG. 1, outside of the glue area. Panel 20 would then be provided with a perforation line 41 extending parallel to the fold line, just outside of the gluing area. In this case, the game component panel 20 could be completely removed, thereby exposing the game rules. After removal of the game components from panel 20, the selvage can be discarded by the consumer.

In a preferred embodiment for forming a rectilinear package, panels 10, 14 and 18 will be identical in size, it being understood that minor variations such as manufacturing tolerances are acceptable. The same is true of panels 12 and 16. Panel 20 should be slightly smaller than panel 18, especially in the direction of the width, so that it will not interfere with the folding between panels 18 and 16. Panels 22 may extend from panel 10 a distance slightly less than that of panel 12, to account for the thickness of tuck flaps 24. Glue strip 30 preferably encompasses about 5 to 20%, more preferably about 10 to 15% of the width of panel 18. Glue panel 28 should be of a size sufficient to provide good bonding to panel 16. Preferably, panel 28 will be about 15 to 30% of the width of panel 16.

Panel 20 can carry a variety of different types of game components 21. Examples include markers, playing cards and spinner cards, all of which can be readily formed of printed paper board or the like. It is also possible to include components which would be attached to the game board to create a three-dimensional playing area, as well as items such as customer response cards, service notices, coupons and contest information and the like. As noted above, it is especially desirable for the components to be delineated with perforations for ease of removal. Depending on the number and type of pieces and game components, additional game component panels can be provided if desired. These panels can be foldably joined to panel 18, panel 20 or both. Although the game component panel is part of the unitary package shell, even after removal of the game components (or removal of the panel itself in the embodiment discussed above) the package is still intact and useful for storing the game.

After the shell has been assembled and the tray, if any, has been inserted, the only steps necessary are the provision of any game pieces not carried on panel 20, e.g. bases for carrying markers and a spinner arrow for a spinner card, and a game board, if any. Alternatively, the game board itself could be printed on one of the panels, e.g. a removable panel 20. It thus would be possible to devise a game in which there are no additional pieces or game boards to be assembled; the package shell would incorporate the entire game. For example, "tent" type marker pieces could be used, which would eliminate the need for plastic bases. A foldable paperboard cube, which could include a variety of different numbers, colors or artwork could be incorporated into the panel 20 to replace a spinner.

It also can be envisioned that a number of different games would use similar pieces other than those carried on panel 20, e.g. colored plastic marker bases, spinner arrows, etc. Since these pieces would be common to a number of different games, the danger of providing the wrong pieces for the game would be minimized; the differing pieces are part of the packaging for the game. Only the correct game board, if not part of the package shell, would need to be associated with the game. The rules and the rest of the pieces would be part of the packaging, thereby rendering it impossible for errors to occur with respect to them.

While a detailed description of the present invention has been provided above, the present invention is not limited thereto, but rather is defined by the following claims.

What is claimed is:

1. A unitary game package having a top, bottom and sides, comprising:

a plurality of shell panels foldably joined together for forming the top, bottom and sides of the game package; and a game component panel, joined to a shell panel, comprising removable components for a game, the shell panels forming an intact package even after removal of the removable components from the game component panel.

2. The game package shell of claim 1, wherein the game component panel is foldably joined to a panel on which rules for the game are provided.

3. The game package of claim 2, wherein the game component panel is foldable onto a surface of the shell panel on which the rules are printed, the game component panel being removable to thereby expose the rules.

4. The game package of claim 1, wherein the game components are part of the game component panel and are defined by perforations.

5. The game package of claim 3, wherein the game component panel is smaller than the shell panel on which the rules are provided.

6. The game package of claim 1, further comprising a panel having means for forming a well for t he package, foldably joined to a shell panel.

7. The game package of claim 5, further comprising a glue strip adjacent to the boundary between the game component panel and the shell panel on which the rules are provided.

8. A game package comprising a unitary game package shell as claimed in claim 6 and a tray which fits into the wall.

9. A family of a plurality of games, wherein each of the plurality of games comprises a game package as claimed in claim 1, each of the games comprising first game components which are common to all member games of the family and second game components which are not common to the other members of the family, said second components being carried on said game component panels.

10. A blank for forming a unitary game package, comprising:

a first panel having means for forming a well;

a second panel for forming a first package side, foldably joined to said first panel and extending from said first panel in a first direction;

a third panel for forming a package bottom, foldably joined to said second panel and extending from said second panel in the first direction;

a fourth panel for forming a second package side, foldably joined to said third panel, extending from said third panel in the first direction;

a fifth panel for forming a package top, foldably joined to said fourth panel, extending from said fourth panel in the first direction; and a sixth panel, comprising removable components for a game, foldably joined to said fifth panel.

11. The blank for forming a unitary game package shell of claim 10, further comprising seventh and eighth panels for forming third and fourth sides, extending from said first panel in directions perpendicular to the first direction.

12. The blank for forming a unitary game package shell of claim 11, further comprising a ninth panel extending from said first panel in a direction opposite to said first direction, comprising a glue strip for attachment to said fourth panel.

13. The blank for forming a unitary game package shell as claimed in claim 10, further comprising a glue strip adjacent the boundary between said fifth and sixth panels.

14. The blank for forming a unitary game package shell of claim 13, wherein said sixth panel is smaller than said fifth panel and said first, third and fifth panels are substantially the same size.

15. The blank for forming a unitary game package shell of claim 14, wherein said sixth panel includes a cut-out tab adjacent the boundary with said fifth panel and said first panel includes a slot for accepting the tab.

* * * * *